US011791561B2

(12) United States Patent
Parra Rubio et al.

(10) Patent No.: US 11,791,561 B2
(45) Date of Patent: Oct. 17, 2023

(54) COMPUTER ASSISTED METHOD FOR MANUFACTURING A FOLDABLE PARABOLOID ANTENNA

(71) Applicant: AIRBUS DEFENCE AND SPACE S.A., Madrid (ES)

(72) Inventors: Alfonso Parra Rubio, Getafe (ES); Álvaro Jara Rodelgo, Getafe (ES); Carlos Enrique Montesano Benito, Madrid (ES)

(73) Assignee: AIRBUS DEFENCE AND SPACE S.A., Madrid (ES)

( * ) Notice: Subject to any disclaimer, the term of this patent is extended or adjusted under 35 U.S.C. 154(b) by 0 days.

(21) Appl. No.: 17/779,502

(22) PCT Filed: Nov. 27, 2019

(86) PCT No.: PCT/ES2019/070810
§ 371 (c)(1),
(2) Date: May 24, 2022

(87) PCT Pub. No.: WO2021/105528
PCT Pub. Date: Jun. 3, 2021

(65) Prior Publication Data

US 2022/0416434 A1 Dec. 29, 2022

(51) Int. Cl.
*H01Q 15/14* (2006.01)
*H01Q 15/16* (2006.01)

(52) U.S. Cl.
CPC ..... *H01Q 15/141* (2013.01); *H01Q 15/161* (2013.01)

(58) Field of Classification Search
CPC .... H01Q 15/141; H01Q 15/142; H01Q 15/16; H01Q 15/161; H01Q 15/162; H01Q 15/165; H01Q 15/166
See application file for complete search history.

(56) References Cited

U.S. PATENT DOCUMENTS 4,811,034 A * 3/1989 Kaminskas ..... F24S 23/71 343/915
11,552,406 B2 * 1/2023 Reveles ..... H01Q 15/161
2021/0013614 A1 * 1/2021 Georgakopoulos .... H01Q 1/288

FOREIGN PATENT DOCUMENTS

CN 113378391 A * 9/2021
WO 2011/097155 A1 8/2011
WO WO-2018233366 A1 * 12/2018

OTHER PUBLICATIONS

S. V. Georgakopoulos et al., "Origami Antennas," in IEEE Open Journal of Antennas and Propagation, vol. 2, pp. 1020-1043, 2021, doi: 10.1109/OJAP.2021.3121102. (Year: 2021).*

(Continued)

*Primary Examiner* — Ab Salam Alkassim, Jr.
*Assistant Examiner* — Leah Rosenberg
(74) *Attorney, Agent, or Firm* — Merchant & Gould P.C.

(57) ABSTRACT

A computer assisted method for manufacturing a foldable paraboloid antenna includes election of a two-dimensional radial Origami pattern with triangular cells and election of a paraboloid surface. The Origami pattern is projected from the paraboloid surface focus onto the paraboloid surface to print the Origami pattern on the paraboloid surface, obtaining triangles with curved sides. A pattern with triangles with straight sides on the paraboloid surface is obtained by joining vertices of the projected curved-sided triangles. The method includes scaling and calculating centroids of the triangles, to reduce each triangle referenced on the corresponding centroid and to determine spacing, obtaining a mesh with segments and triangular cells delimited by the segments. The triangular cells have triangles of reflective rigid material. The mesh is flexible, so each segment width is at least the sum of the thicknesses of two adjacent rigid triangles, and periphery cells have a rounded outer edge.

8 Claims, 9 Drawing Sheets

(56) References Cited

OTHER PUBLICATIONS

D. Sessions et al., "Folding, Tessellation, and Deployment of an Origami-Inspired Active-Material-Enabled Self-Folding Reflector Antenna", IEEE International Symposium on Antennas and Propagation & USNC.URSI National Radio Science Meeting : 929-930 (2018).
L. Datashvili et al., "Structural Solutions of Deployable Antennas for Small Satellites", 13th European Conference on Antennas and Propagation (EuCAP 2019): 1-4 (2019).
International Search Report and Written Opinion for PCT/ES2019/070810 (dated Aug. 28, 2020).

* cited by examiner

PRIOR ART

2 FIG. 3 3

COMPUTER ASSISTED METHOD FOR MANUFACTURING A FOLDABLE PARABOLOID ANTENNA

This application is a National Stage Application of PCT/ES2019/070810 filed Nov. 27, 2019, which application is incorporated herein by reference. To the extent appropriate, a claim of priority is made to the above disclosed application.

FIELD OF THE INVENTION

The present invention relates to a computer assisted method for manufacturing a foldable paraboloid antenna, of the kind that can be deployed in space to perform antenna or reflector functions.

BACKGROUND

There are several examples of foldable structures such as an antenna used in space applications.

The Japanese engineer Koryo Miura designed a folding solar panel applied to a satellite in 1995.

Other projects have used patterns as shapes for structures that deploy after the launch and delivering in orbit is completed. One example is the "Eyeglass Telescope Project" by the Lawrence Livermore National Laboratory (LLNL) in collaboration with Robert J. Lang, which follows an Origami pattern.

Another project that uses a technique of folding is the James Webb Space Telescope.

All these proposals refer to systems that are able to fold in a solid state to be used in space, and when unfolded they generate a flat surface.

On the other hand, there are systems composed by an element that behaves as an antenna and a tensegritic structure that holds the antenna and provides its shape. In order to be able to be folded and unfolded, a solution proposed has been to use a metallic fabric attached to the control points of the tensegrity structure. However, in this proposal the size of the holes generated by the fabric crosses (warp and weft) decrease the range of frequencies able to be reflected. High band frequencies (higher than 60 GHz) are smaller than those holes, so they go through the antenna and are not reflected.

SUMMARY OF THE INVENTION

Thus, it is an object of the invention to provide a computer assisted method for manufacturing an antenna with a surface without holes able to unfold into a paraboloid surface.

The invention provides a computer assisted method for manufacturing a foldable paraboloid antenna that comprises the following steps:

- election of a two-dimensional radial Origami pattern with triangular cells and election of a paraboloid surface,
- the two-dimensional radial Origami pattern with triangular cells is projected from the focus of the paraboloid surface on the paraboloid surface in order to print the Origami pattern on the paraboloid surface, obtaining triangles with curved sides,
- obtention of a pattern with triangles with straight sides on the paraboloid surface by joining the vertices of the projected triangles with curved sides,
- calculating the centroids of the triangles and scaling of the triangles with a homothetic operation from the focus, in order to reduce each triangle taking as a reference the corresponding centroid and to determine the spacing between triangles, obtaining a mesh with a plurality of segments and a plurality of triangular cells delimited by the segments of the mesh,
- the triangular cells are filled with triangles of a reflective rigid material,
- the mesh of the antenna is manufactured with a flexible material, such that the width of each segment is at least the sum of the thicknesses of the two adjacent rigid triangles, and
- the cells on the periphery are manufactured with a rounded outer edge.

The invention allows that in an unfolded position a non-planar antenna with a general paraboloid shape is obtained, the segments of the flexible mesh acting as hinges between two adjacent triangles.

Other features and advantages of the present invention will become apparent from the following detailed description of an illustrative embodiment and not limiting its purpose in connection with the accompanying figures.

DETAILED DESCRIPTION OF THE INVENTION

In this description the simplest subdivisions that can be made in an Origami folding pattern will be called a "unitary cell"

Figure 1:
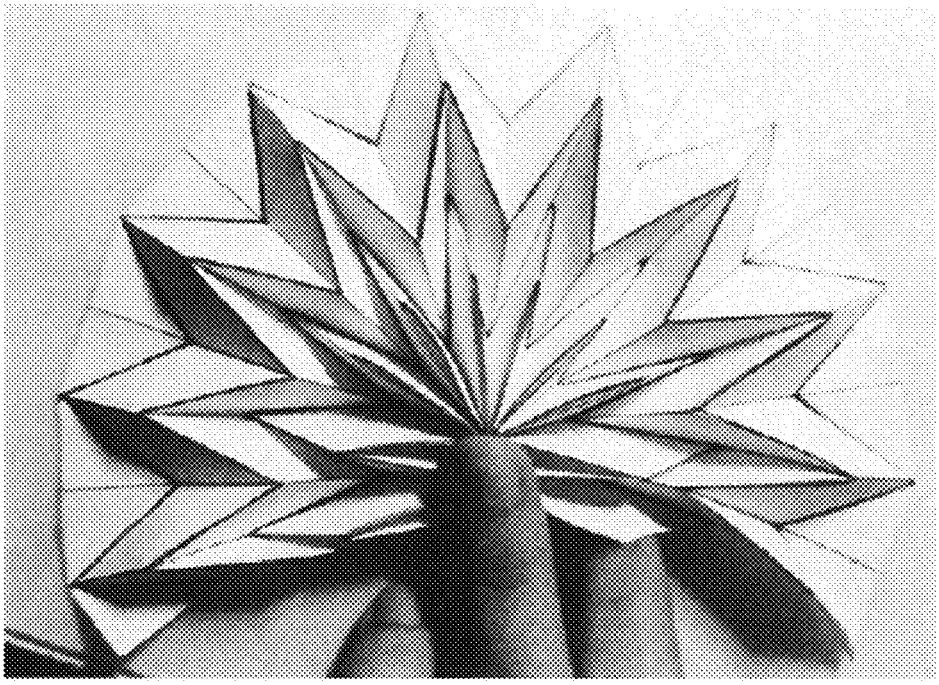
FIG. 1 is a view of a known Origami pattern.
Figure 2:
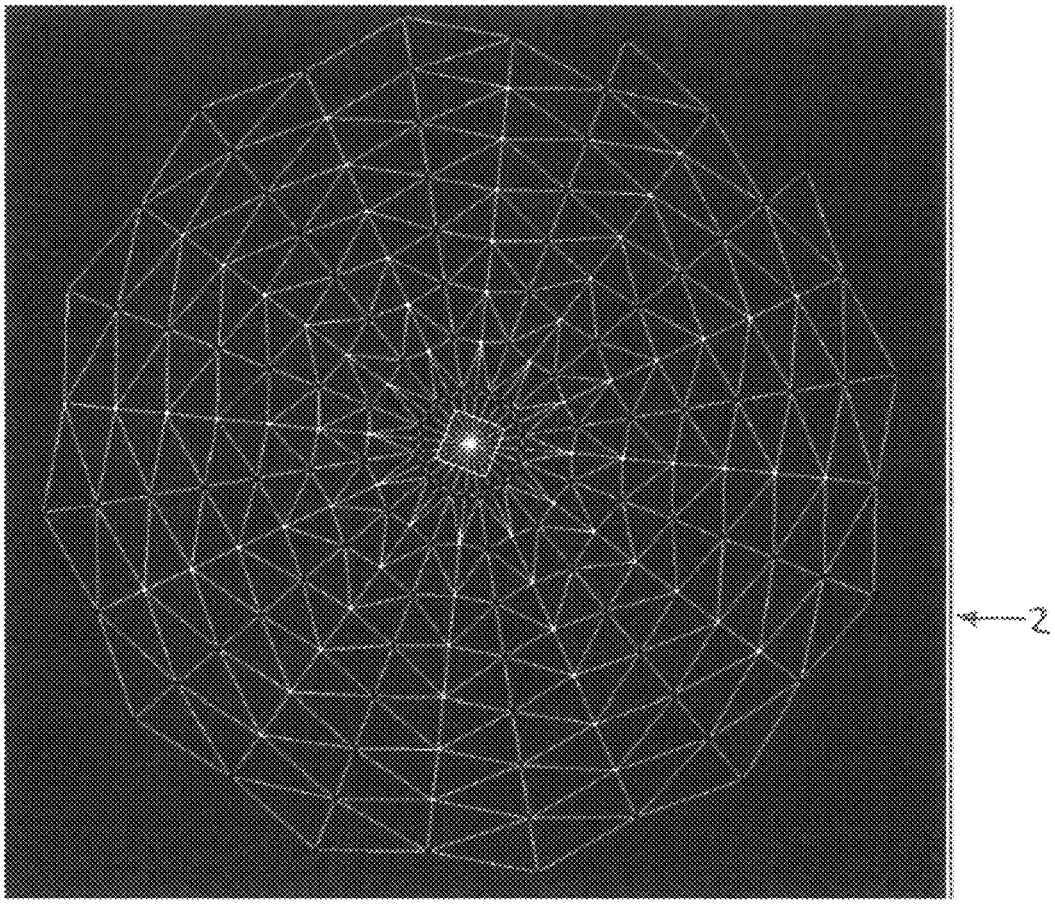
FIG. 2 is a view of an Origami pattern with triangular cells.

FIG. 1 shows a known Origami pattern being able to fold and unfold radially and comprising unitary cells with four sides. FIG. 2 shows an Origami pattern being able to fold and unfold radially with unitary cells of triangular shape (in this figure it is shown in its unfolded state). Both patterns are able to unfold into a planar circular shape.

In order to be able to obtain a foldable paraboloid antenna, a computer assisted method is performed, which can use a software such as CATIA.

Figure 3:
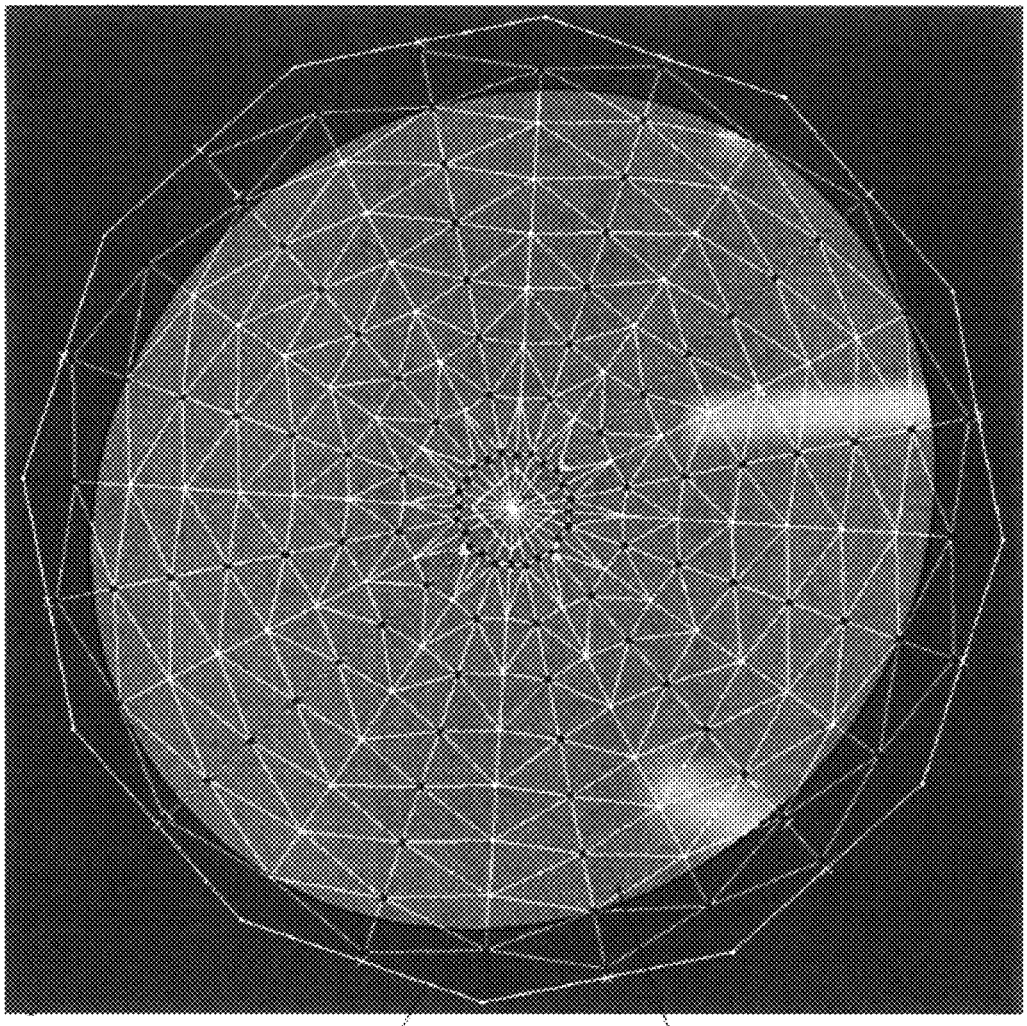
FIG. 3 is a view of the two-dimensional radial Origami pattern with triangular cells and the paraboloid surface used in an embodiment of the method of invention.

A two-dimensional radial Origami pattern with triangular cells (such as the one shown in FIGS. 2 and 3) is chosen, and also a desired geometry is chosen (in this case, a paraboloid surface as a non-planar surface for the antenna, as shown in FIG. 3).

Figure 4:
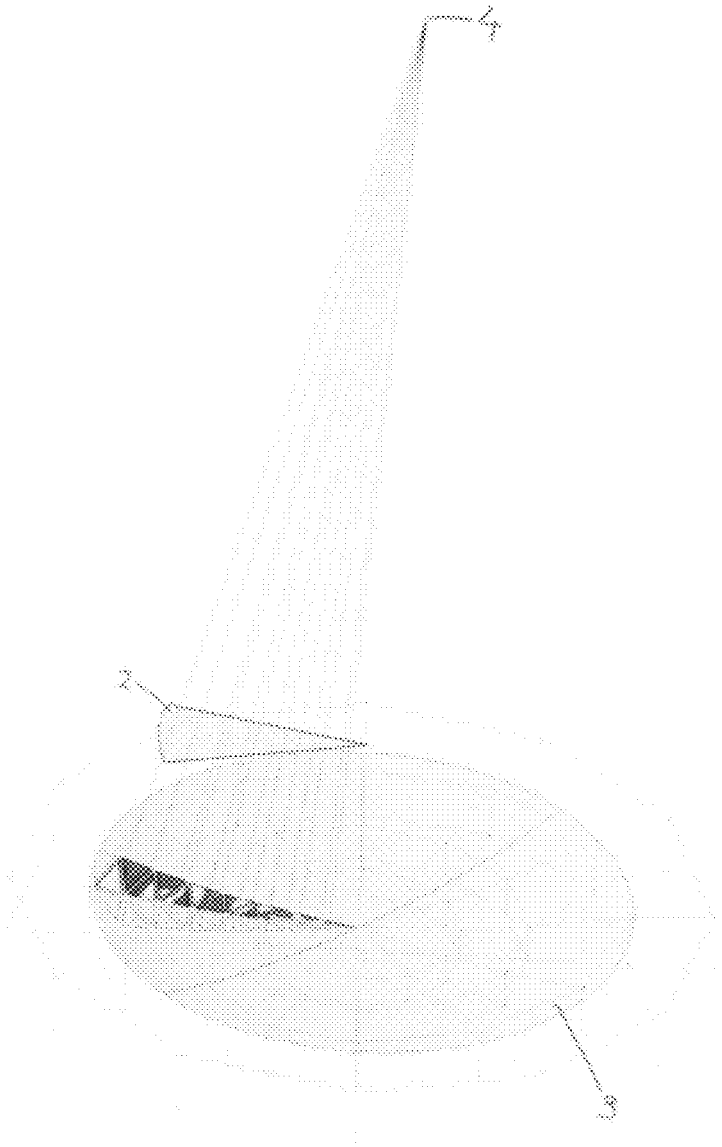
FIG. 4 is a view of the projection of a sector of the Origami pattern of FIG. 2 on the paraboloid surface of FIG. 3.

FIG. 4 shows the projection of the two-dimensional radial Origami pattern with triangular cells from the focus of the paraboloid surface on the paraboloid surface. The projection is generated to print the Origami pattern on the paraboloid surface. After this step, a triangularization of the paraboloid surface is made, obtaining triangles with curved sides.

Figure 5:
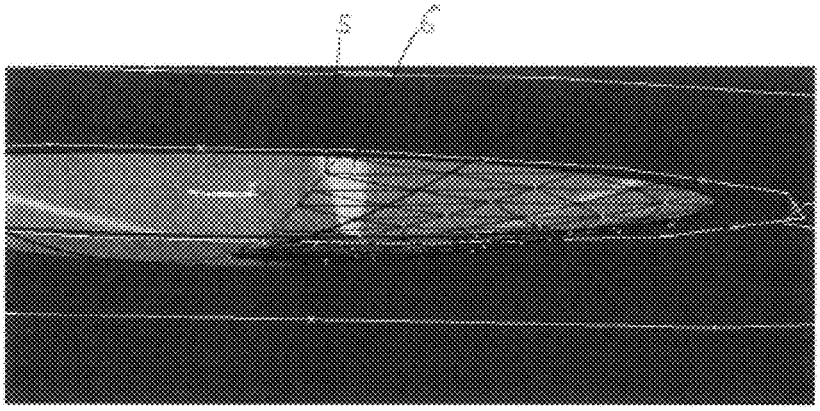
FIG. 5 is a detail of the triangularization of the paraboloid surface.

The next step consists in transforming the triangles with curved sides into triangles with straight sides. For this purpose, the vertices of the projected triangles with curved sides are selected, and then they are joined to form a pattern with triangular cells with straight sides, as shown in FIG. 5.

Figure 6:
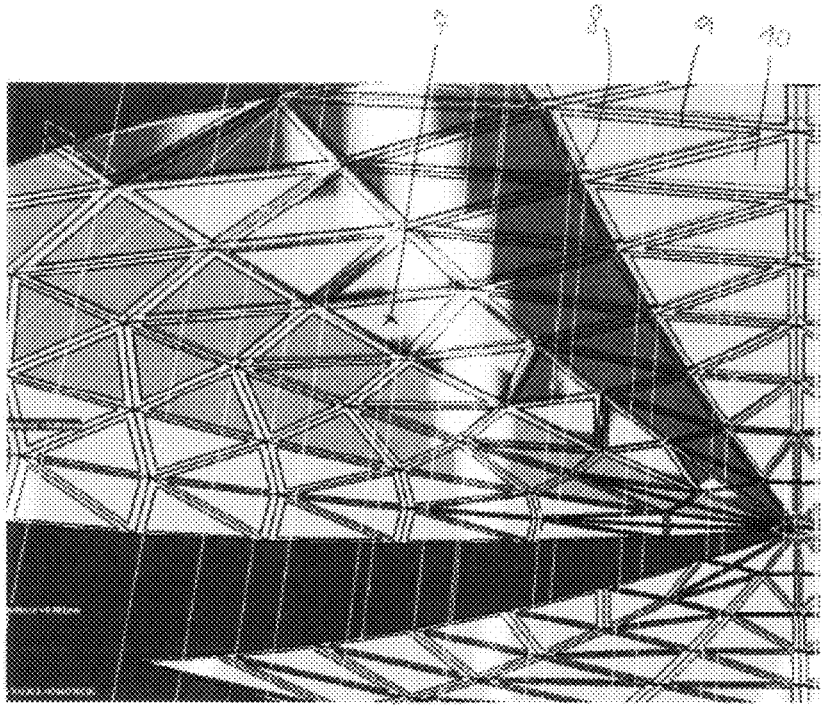
FIG. 6 is a view of the triangles and their centroids.

Once defined the pattern, it is necessary to design the hinges that can make the triangles fold. In order to do that, the centroids of the triangles are calculated to make a progressive scaling of each triangle with a homothetic operation from the focus (see FIG. 6)

Figure 7:
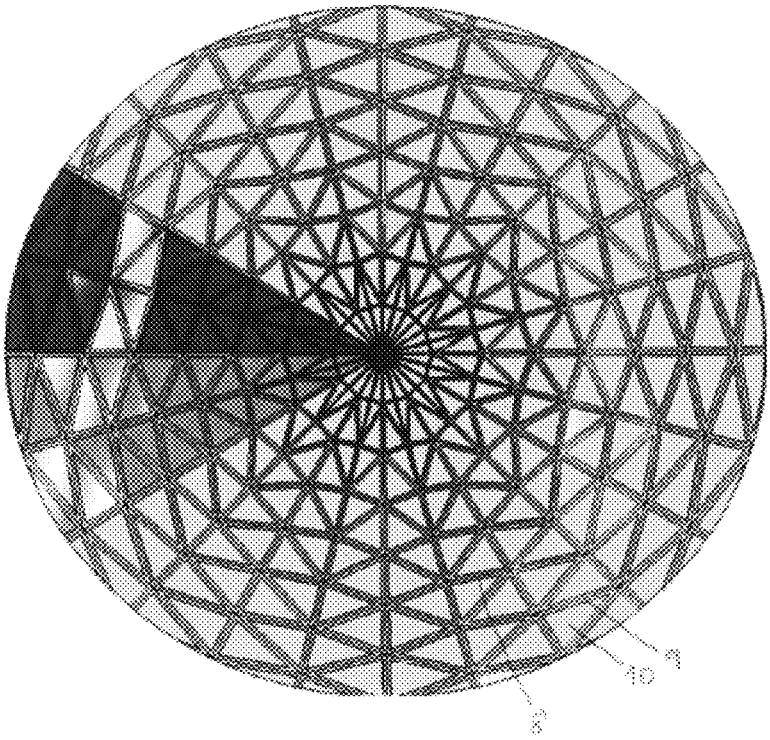
FIG. 7 is a plan view of the pattern for the foldable paraboloid antenna.

Once each triangle has been reduced locally taking as a reference the centroid (which avoids the displacement of the corresponding triangle), we can obtain a surface with a parametrized spacing between triangles. A mesh with a plurality of segments and a plurality of triangular cells delimited by the segments of the mesh is obtained by computer, as shown in FIG. 7.

It is important to take into account that the above process can be made by sectors of the paraboloid, i.e., the two-dimensional radial Origami pattern with triangular cells can be divided in several sectors (for instance, 12 sectors), and the steps of the method are repeated for each sector separately (for instance, FIG. 4 shows the projection of a sector of the paraboloid of the two-dimensional radial Origami pattern).

Figure 9:
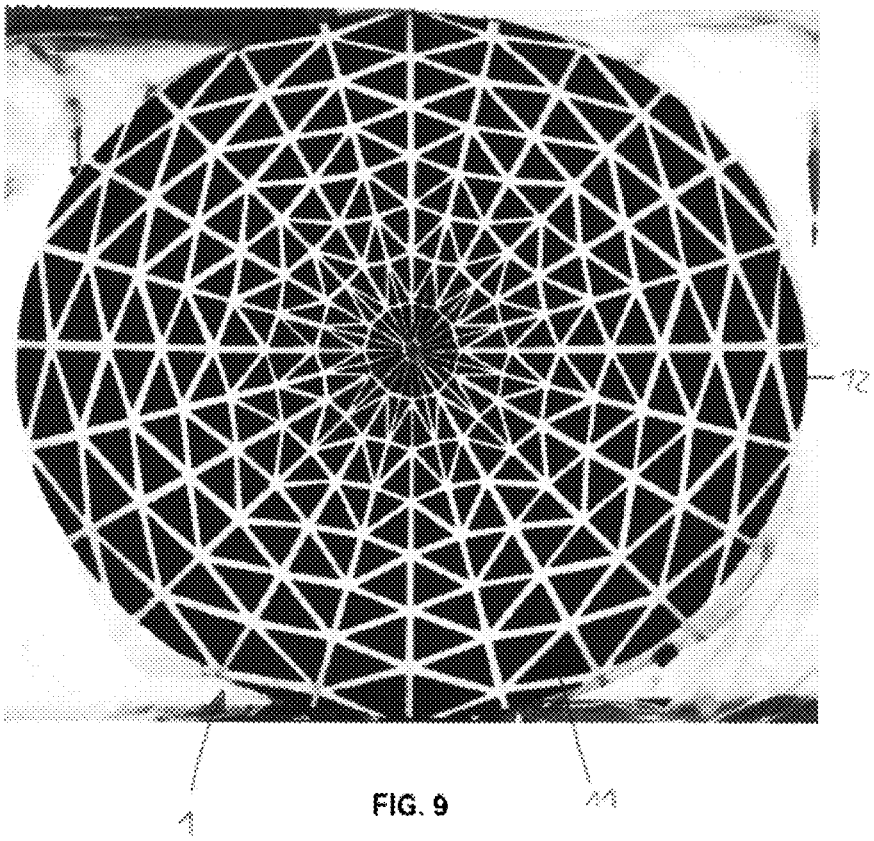
FIG. 9 is a plan view of the assembled foldable paraboloid antenna.

Afterwards the antenna is assembled (see FIG. 9). The triangular cells are filled with triangles of a reflective rigid material, and the mesh with segments is manufactured with a flexible material. As the periphery of the paraboloid surface is rounded, the cells on the periphery are manufactured with a rounded outer edge.

In order to avoid the contact between two adjacent triangles when the antenna is folded, the width of each segment of the mesh is at least the sum of the thicknesses of the two adjacent rigid triangles.

Figure 8:
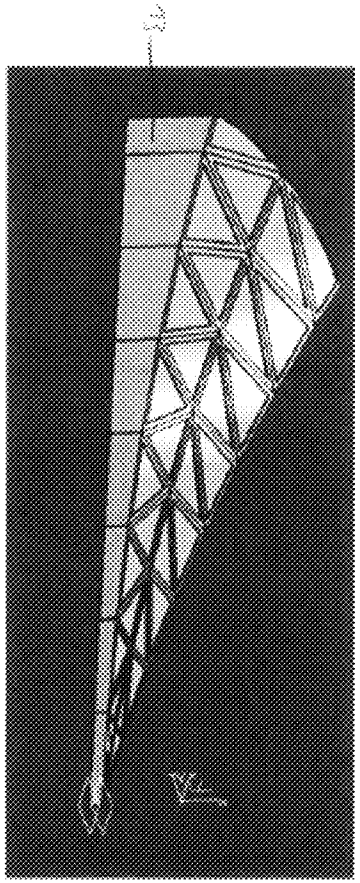
FIG. 8 is a view of one sector of the support tool for the assembly of the foldable paraboloid antenna

A tool for support of the paraboloid antenna while being assembled can be used. This tool can be divided in sectors, as shown in FIG. 8.

The mesh of the paraboloid antenna (shown in FIG. 9) has to be made in a flexible material. For example, it can be made of PEEK or Kapton® material, or a metallized material.

The triangles have to be made in a reflective rigid material (for example, CFRP). In an embodiment, the CFRP used has a thickness of 1 mm, so in that case the distance between adjacent triangles is at least 2 mm, to avoid the contact or overlapping between the adjacent triangles when the antenna is folded.

Once the foldable paraboloid antenna has been manufactured, it is placed on the tensegrity structure and is joined to it through pins. Accordingly, the foldable paraboloid antenna is held by a tensegrity structure being able to fold radially. When unfolded, a triangularization of a non-flat structure (a paraboloid) is obtained.

Although the present invention has been fully described in connection with preferred embodiments, it is apparent that modifications can be made within the scope, not considering this as limited by these embodiments, but by the content of the following claims.

NUMBER REFERENCES

1—Foldable paraboloid antenna
2—Two-dimensional radial Origami pattern
3—Paraboloid surface
4—Focus
5—Vertices
6—Triangles
7—Centroids
8—Mesh
9—Segment
10—Triangular cells
11—Triangles of a reflective rigid material
12—Cells on the periphery
13—Tool

The invention claimed is:

1. A computer assisted method for manufacturing a foldable paraboloid antenna, the method comprising the following steps:

selecting a two-dimensional radial Origami pattern with triangular cells and selecting a paraboloid surface, projecting the two-dimensional radial Origami pattern with triangular cells from the focus of the paraboloid surface on the paraboloid surface in order to print the Origami pattern on the paraboloid surface, and afterwards triangularizing the paraboloid surface to obtain triangles with curved sides, obtaining a pattern with triangles with straight sides on the paraboloid surface by joining vertices of the projected triangles with curved sides, calculating centroids of the triangles and scaling of the triangles with a homothetic operation from the focus, in order to reduce each triangle taking as a reference a corresponding centroid and determining spacing between triangles, obtaining a mesh with a plurality of segments and a plurality of triangular cells delimited by the segments of the mesh, the segments acting as hinges that enable folding of the triangles, the triangular cells are filled with triangles of a reflective rigid material, the mesh of the antenna is manufactured with a flexible material, such that a width of each segment is at least the sum of thicknesses of two adjacent rigid triangles, and the cells on the periphery are manufactured with a rounded outer edge.

2. The computer assisted method for manufacturing a foldable paraboloid antenna, according to claim 1, wherein the two-dimensional radial Origami pattern with triangular cells is divided in a plurality of sectors of a paraboloid, and the steps of the method are repeated for each sector separately.

3. The computer assisted method for manufacturing a foldable paraboloid antenna, according to claim 1, comprising using a tool for support of the paraboloid antenna while being assembled.

4. The computer assisted method for manufacturing a foldable paraboloid antenna, according to claim 1, wherein the flexible mesh is made of PEEK.

5. The computer assisted method for manufacturing a foldable paraboloid antenna, according to claim 1, wherein the flexible mesh is made of Kapton® material.

6. The computer assisted method for manufacturing a foldable paraboloid antenna, according to claim 1, wherein the flexible mesh is made of a metallized material.

7. The computer assisted method for manufacturing a foldable paraboloid antenna, according to claim 1, wherein the triangles of a reflective rigid material are made of CFRP.

8. The computer assisted method for manufacturing a foldable paraboloid antenna, according to claim 7, wherein the thickness of the triangles made of CFRP is 1 mm.

* * * * *